US011891232B2

(12) United States Patent
Bermudez et al.

(10) Patent No.: US 11,891,232 B2
(45) Date of Patent: Feb. 6, 2024

(54) CONTAINER FOR ELONGATED CONSUMER ARTICLES WITH A TILTED LONGITUDINAL EDGE BETWEEN THE BOX FRONT WALL AND A SIDE WALL

(71) Applicant: Philip Morris Products S.A., Neuchatel (CH)

(72) Inventors: Fernando Bermudez, Neuchatel (CH); Alexander Androsenko, Neuchatel (CH); Jacques Roethlisberger, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 17/996,522

(22) PCT Filed: Apr. 16, 2021

(86) PCT No.: PCT/EP2021/059870
§ 371 (c)(1),
(2) Date: Oct. 19, 2022

(87) PCT Pub. No.: WO2021/213908
PCT Pub. Date: Oct. 28, 2021

(65) Prior Publication Data

US 2023/0074684 A1 Mar. 9, 2023

(30) Foreign Application Priority Data

Apr. 21, 2020 (EP) ..... 20170606

(51) Int. Cl.
*B65D 85/10* (2006.01)

(52) U.S. Cl.
CPC ..... *B65D 85/1048* (2020.05)

(58) Field of Classification Search
CPC ..... B65D 85/1048; B65D 85/1045; B65D 85/1036; B44D 3/04
(Continued)

(56) References Cited

U.S. PATENT DOCUMENTS

2006/0208050 A1 9/2006 Petrucci et al.
2014/0339108 A1* 11/2014 Chatelain ..... B65D 85/10564 206/268
2015/0090618 A1* 4/2015 Marchitto ..... B65D 5/6688 206/268

FOREIGN PATENT DOCUMENTS

EP 2 883 808 A1 6/2015
JP 2006-240744 A 9/2006
(Continued)

OTHER PUBLICATIONS

International Search Report and Written Opinion, dated May 11, 2021 in PCT/EP2021/059870, filed on Apr. 16, 2021, 3 pages.
(Continued)

*Primary Examiner* — Rafael A Ortiz
(74) *Attorney, Agent, or Firm* — Oblon, McClelland, Maier & Neustadt, L.L.P.

(57) ABSTRACT

A container for consumer goods including elongated articles is provided, including: a lid and a box for housing consumer goods, the box including a box front wall with a box front lower section and a box front upper section and a first box side wall and a second box side wall, the upper first longitudinal edge in the box front upper section being tilted with respect to the lower first longitudinal edge in the box front lower section so that the upper first longitudinal edge is at an angle to the lower first longitudinal edge. The titled upper first longitudinal edge may advantageously assist in a smooth lid closure by reducing the risk that the lid catches the upper edges of the box when the lid rotates to its close position.

16 Claims, 9 Drawing Sheets

(58) Field of Classification Search
USPC ..... 206/242, 268, 273, 265, 575, 224, 81, 206/1.7, 1.8, 1.9
See application file for complete search history.

(56) References Cited

FOREIGN PATENT DOCUMENTS

| | | | | | |
|---|---|---|---|---|---|
| TW | 201406628 | A | | 2/2014 | |
| WO | WO-2013190494 | A2 | * | 12/2013 | ..... A24F 15/12 |
| WO | WO-2017001615 | A1 | * | 1/2017 | ..... B65D 5/6685 |

OTHER PUBLICATIONS

International Preliminary Report on Patentability and Written Opinion dated Oct. 25, 2022 in PCT/EP2021/059870, 7 pages.

* cited by examiner

CONTAINER FOR ELONGATED CONSUMER ARTICLES WITH A TILTED LONGITUDINAL EDGE BETWEEN THE BOX FRONT WALL AND A SIDE WALL

The present invention relates to a container for consumer goods, in particular, elongated articles, such as for example aerosol generating articles, crayons or cigarettes.

The elongated consumer articles such as aerosol generating articles or cigarettes are commonly packaged in rigid hinge-lid containers having a box and a lid connected to the box portion along a hinge line extending across the rear wall of the container. Such hinge-lid containers are typically constructed from paperboard blanks. In use, the lid portion is pivoted about the hinge line to open the container and so gain access to elongated articles housed in the box portion.

Conventionally, a separate inner frame made of paperboard is housed in the interior of the container to provide additional stability to the container and to aid in the retention of the lid when the lid is closed. This inner frame normally defines the correct position of the lid when the lid is closed and furthermore prevents an accidental opening of the lid by applying pressure to the lid from the inside. Such an inner frame is connected to the container by gluing. The group of elongated articles housed in the box portion is typically wrapped in an inner liner of metallised paper, metal foil or other flexible sheet material, to form an inner bundle.

U.S. Pat. No. 2,163,828 describes a hinge lid box made of one piece of blank with an inner frame integrated. However, such types of boxes often suffer from a number of disadvantages. For example, the top of the body portion of the box might be prone to catch the lid, when the lid rotates to its close position. The frequent collision between the lid and the box make such a box inconvenient to use.

It is an object of the present invention to provide an improved container for elongated articles that overcome the above drawbacks. The improved container may aid in the closing of the lid. At the same time the container is cheap and easy to produce.

According to an embodiment of the invention there is provided a container for consumer goods, such as elongated articles which may comprise a housing with a box and a lid. The box may comprise a box front wall, a box rear wall, a first box side wall, a second box side wall and a box bottom wall. The top end of the box may at least partially be open to provide an access opening for accessing the consumer goods. The lid may be pivotably connected to the box rear wall about a hinge. The lid may be pivotable about the hinge between a closed position in which the lid covers the excess opening, and an open position, in which the excess opening is exposed. The box front wall may comprise a box front lower section and a box front upper section and the first box side wall may comprise a first box side lower section and a first box side upper section. Similarly, the second box side wall may comprise a second box side lower section and the second box side upper section. The box front lower section, the first box side lower section and the second box side lower section may be adjacent to the box bottom wall. The box front upper section, the first box side upper section and the second box side upper sections may be configured to be covered by the lid, when the lid is in its closed position. The container may additionally comprise a first longitudinal edge connecting the first box side wall with the box front wall of the container. The upper first longitudinal edge in the box front upper section may be tilted with respect to the lower first longitudinal edge in the box front lower section, so that the upper first longitudinal edge is at an angle to the lower first longitudinal edge.

According to an embodiment of the invention there is provided a container for elongated consumer articles such as elongated articles which comprises a housing with a box and a lid. The box comprises a box front wall, a box rear wall, a first box side wall, a second box side wall and a box bottom wall. The top end of the box is at least partially open to provide an access opening for accessing the consumer goods. The lid is pivotably connected to the box rear wall about a hinge. The lid is pivotable about the hinge between a closed position in which the lid covers the access opening, and an open position, in which the access opening is exposed. The box front wall comprises a box front lower section and a box front upper section and the first box side wall comprises a first box side lower section and a first box side upper section. The second box side wall comprises a second box side lower section and a second box side upper section. The box front lower section, the first box side lower section and the second box side lower section are adjacent to the box bottom wall. The box front upper section, the first box side upper section and the second box side upper sections are configured to be covered by the lid, when the lid is in its closed position. The container additionally comprises a first longitudinal edge connecting the first box side wall with the box front wall of the container. The upper first longitudinal edge in the box front upper section is tilted with respect to the lower first longitudinal edge in the box front lower section, so that the upper first longitudinal edge is at an angle to the lower first longitudinal edge.

By providing the container with a tilted first longitudinal edge, where the upper first longitudinal edge in the box front upper section is at an angle to the lower first longitudinal edge in the box front lower section, the top end of the box may slightly taper. The tapered top end of the box may advantageously help a smooth lid closure by reducing the risk that the lid catches the upper edges of the box when the lid rotates to its close position.

In addition, by providing the container with the tilted upper first longitudinal edge, such a container may comprise parts of the box front upper section, the first box side upper section or both of the box front upper section and the first box side upper section of the box protruding outwards from the container due to the force of tension from the tilted edge. These protruding sections may frictionally engage with the lid from the inside and press against the lid, when the lid is in its closed position. This may assist in avoiding any accidental opening of the lid.

In the following description of the invention the terms "side", "top", "bottom", "front", "back" and other terms used to describe relative positions of the components of containers according to the invention refer to the container in an upright position with the access opening at the top. When describing containers according to the present invention, these terms are used irrespective of the orientation of the container being described. The "bottom" of the container refers to the side of the container opposite the "top" of the container.

The term "wall" refers more generally to a face of the container, and a wall may be formed from a single panel or flap, or a wall may be formed from two or more abutting or overlapping panels or flaps.

The term "panel" is used herein to refer to a portion of the container formed from a single, continuous portion of material. A panel may depend from one or more other panels.

The term "fold line" is used to describe any line of a blank about which the blank is folded. The fold line may be defined by a line of weakness to assist with the folding action.

The term "height" is used herein to refer to dimensions extending between the top and the bottom. The term "width" is used herein to refer to dimensions extending between two sides.

The term "inner surface" is used throughout the specification to refer to the surface of a component of the assembled container that is facing towards the interior of the container, for example towards the consumer goods, when the container is in the closed position.

In some embodiments, the container may additionally comprise a second longitudinal edge connecting the second box side wall with the box front wall of the container. The upper second longitudinal edge in the box front upper section may be tilted with respect to the lower second longitudinal edge in the box front lower section so that the upper second longitudinal edge is at an angle to the lower second longitudinal edge.

Similarly, by providing the container with a tilted first longitudinal edge, the provision of a titled second longitudinal edge also help the top end of the box to taper. The tapered top end of the box may advantageously help a smooth lid closure by reducing the risk that the lid catches the upper edges of the box when the lid rotates to its close position.

In addition, the tilted upper second longitudinal edge may lead to parts of the box front upper section, the second box side upper section or both the box front upper section and the second box side upper section protruding outwards from the container. These protruding sections may additionally frictionally engage with the lid from the inside in addition to the protruding sections between the box front upper section and the first box side upper section. Such a container may provide additional safeguard against accidental opening.

One or both of the upper first longitudinal edge and the upper second longitudinal edge may be tilted towards a central longitudinal axis of the box front wall. This may lead to the width of the box front upper section decreasing towards the lid. The width of the box front upper section may be measured as the narrowest width of the box front wall in the upper section between the upper first longitudinal edge and the upper second longitudinal edge parallel to the box bottom wall. The width of the box front upper section gradually decreasing towards the lid leads to the top end of the box being tapered. The tapered top end of the box may also advantageously assist in the smooth lid closure by reducing the risk that the lid catches the upper edges of the box when the lid rotates to its close position.

The width of the box front upper section may be between 0.1 percent to 5 percent, preferably between 0.5 percent to 3 percent smaller than the width of the box front lower section. For example, the width of the box front upper section may be 2 to 3 millimeters smaller than the width of the box front lower section.

The angle of tilt between the upper first longitudinal edge and the lower first longitudinal edge is defined to be the angle between the tilted upper first longitudinal edge and an imaginary first longitudinal edge, which is a straight extension of the lower first longitudinal edge from the box front lower section into the box front upper section. The angle of tilt may then be measured starting from the vertex point where the tilted upper first longitudinal edge in the box front upper section diverges from the lower first longitudinal edge (see also FIG. 4 describing a way for determining the tilt angle between the upper first longitudinal edge and the lower first longitudinal edge). The tilt angle between the upper second longitudinal edge and the lower second longitudinal edge may be defined in the same way.

The upper first longitudinal edge or the upper second longitudinal edge or both the upper first longitudinal edge and the upper second longitudinal edge may be at an angle of between 2 degrees to 8 degrees, preferably 4 degrees to 6 degrees, most preferably 5 degree. These tilt angles may lead the outer surface of the container in the front upper section to be convex outward instead of being flat as the outer surface of the container in the box front lower section. The outwardly arched box front upper section is particularly advantageous to secure the closed lid and to minimize any accidental opening, because the convex surface of the container may inevitably increase the frictional engagement between the upper portion of the box and the inner surface of the lid in the lid's closed position.

Alternatively of being tilted towards the central longitudinal axis of the box front wall, the upper first longitudinal edge or upper second longitudinal edge or both the upper first longitudinal edge and the upper second longitudinal edge may be tilted away from the central longitudinal axis of the box front wall. This may result in the width of the box front upper section increasing towards the lid.

One or both of the upper first longitudinal edge and upper second longitudinal edge may be tilted away from the central longitudinal axis of the box front wall by a tilt angle of between 2 degrees to 10 degrees, preferably 5 degrees to 10 degrees.

The box front upper section and the first box side upper section and the second box side upper section may be covered, preferably entirely covered, by the lid, when the lid is in its closed position. This may ensure that the outwardly arched surface of the box front upper section is completely covered by the lid front wall, when the lid is closed.

The container may be manufactured from a one-piece blank. This may simplify the manufacturing procedure. Additionally, using such a blank may not require any major modification of existing packaging apparatuses. Such a container may be cheap and easy to produce. Additionally, such a container may require less material than conventional containers which often contain additional parts produced from separate blanks attached to the container. In particular, the container does not comprise a separate inner frame. In conventional containers an inner frame is normally glued to an inner surface of the box of the container. This inner frame may have a U-shape with front and side walls against which the lid closes. Such an inner frame may not be necessary for the container of the present invention, because the function of the inner frame is taken over by the upper section of the box front wall and the upper section of the first box side wall and the upper section of the second box side wall.

The container may be manufactured from one single one-piece blank, which may be paperboard or plastics or a combination of paperboard or plastics, preferably paperboard.

The box front lower section may be in the same plane surface with the box front upper section. This can be achieved particularly well when container is manufactured from one single piece of blank, especially when the whole box front wall comprising the box front lower section and the box front upper section is formed by one blank panel. In this case the container may be devoid of any additional separate parts which are glued or otherwise attached to the container.

In one embodiment of the container, a minimum height of the first box side wall, or a minimum height of the second box side wall or both a minimum height of the first box side wall and the second box side wall may be at the same height or lower than the height of the box rear wall. These low heights of the first box side wall, or the second box side wall or both box side walls may ensure that the box side walls do not interfere with the lid side walls when the lid is being closed. In particular, while being closed, the lid will pivot about the hinge, wherein the position of the hinge within the container is determined by the height of the box rear wall which directly connects via the hinge to the lid rear wall. Configuring the box side walls in such a way that at least parts of the box side wall have a height which is located below or at the same level as the hinge of the lid may ensure that the lid can properly be closed without any major interference from the box side walls. In particular, such configuration of the box side walls may advantageously reduce the risk of collision between the box side walls and lid side wall at the initial move of the lid upon pivoting from the open position to the close position. Preferably, the height of the first box side wall adjacent to the box rear wall may be smaller than the height of the first box side wall adjacent to the box front wall, or the height of the second box side wall adjacent to the box rear wall may be smaller than the height of the second box side wall adjacent to the box front wall, or both the heights of the first box side wall and the second box side wall adjacent to the box rear wall may be smaller than the heights of the first box side wall and the second box side wall adjacent to the box front wall. This may ensure proper closing of the lid and at the same time may provide sufficient support for the box front wall, in particular for the box front upper section.

In one embodiment of the container, the height of the first box side wall, or the height of the second box side wall or both the heights of the first box side wall and the second box side wall may continuously increase starting from the box rear wall to the box front wall. In another embodiment the height of the first box side wall, or the height of the second box side wall or both the heights of the first and the second box side wall may run parallel to the box bottom wall when starting from the box rear wall and when further going towards the box front wall the height of the box side walls may subsequently increase.

In a further embodiment of the container, the height of the first box side wall, or the height of the second box side wall or both the heights of the first and the second box side wall may decrease when starting from the box rear wall until a minimum of the height of the box side walls is reached. Starting from that minimum, the height of the first box side wall, or the second box side wall or both the first and the second box side wall may then increase towards the box front wall, in particular the box front upper section. These designs of the box side walls may be particularly well suited in order to avoid a collision of the side walls with the lid side walls during closing of the lid.

Both the first box side upper section and the second box side upper section may comprise upper edges which are adjacent to the top end of the box and which define the periphery sides of the access opening for accessing the consumer goods. The upper edge of the first box side upper section, the upper edge of the second box side upper section or both the upper edges of the first box side upper section and the second box side upper section may comprise a recess formed by a cut-out portion. A cut-out portion is a part of the container blank which is cut away from the blank. The removal of the cut-out portion forms a recessed upper edge of a box side wall. A straight connecting imaginary line may be drawn between the edge of the box side upper section being directly adjacent to the box front upper section and the edge of the box side upper section being directly adjacent to the rear wall. The upper edge of the box side walls may at least partially be located below this imaginary line in order to comprise a cut-out portion. (see also FIG. 9 detailing the definition of the cut-out portion).

In some embodiments of the container, the cut-out portion may be positioned on the upper edge of the box side wall adjacent to the box rear wall, so that the upper edge of the first box side wall adjacent to the rear wall or the upper edge of the second box side wall adjacent to the rear wall or both the upper edges of the first box side wall and the upper edge of the second box side wall adjacent to the rear wall is located below the hinge between the box rear wall and the lid rear wall. Such a configuration may ensure that the upper edges of the first box side wall and the second box side wall do not interfere with the lid side walls when closing the lid.

The lid of the container may comprise a lid top wall, a lid rear wall, two opposing lid sidewalls and a lid front wall. The lid rear wall may be the part of the lid which is pivotally attached to the box. In particular, the lid rear wall may be pivotally attached to the rear box wall along a hinge. The lid front wall may cover, preferably entirely cover, the box front upper section in its closed position. Similarly, the lid side walls may cover, preferably entirely cover, the first box side upper section and the second box side upper section, when the lid is closed.

The width of the lid top wall of the container may be larger than the width of the box rear wall of the box. In particular, the width of the lid top wall may be between 2 percent to 10 percent, preferably between 3 percent to 8 percent larger than the width of the rear wall of the box. For example, the width of the lid top wall may be 2 to 3 millimetres larger than the width of the rear wall of the box.

Alternatively, or in addition, the width of the lid top wall may be larger than the narrowest width of the box front upper section of the box when one or both of the upper first longitudinal edge and the upper second longitudinal edge are tilted towards the central longitudinal axis of the box front wall. In particular the width of the lid top wall may between 2 percent to 10 percent, preferably between 3 percent to 8 percent larger than the narrowest width of the front upper section. For example, the width of the lid top wall may be 2 to 3 millimetres larger than the narrowest width of the box front upper section. This may ensure a good balance between a reliable closure of the box by sufficient frictional engagement of the box front upper section with the inside of the lid to maintain the closure of the lid and an easy closure of the lid by reducing the risk of any collision between the lid and the box when the lid pivots from the open position to the close position. The lid front wall may protrude outwards due to the larger dimensions of the lid top wall. The outward protruding lid front wall allows the closing of the lid, even when the box front upper section also protrudes outwards due to the tilt angles in one or both the upper first longitudinal edge and upper second longitudinal edge.

The lid front wall may overlie and cover the box front upper section when the lid is closed. Since the box front upper section may be in the same plane surface with the box lower section, the lid front wall overlying on the top of the box front wall protrudes from the front lower section when the lid is closed. The lid front wall may thus not be flush with the front lower section of the box. This may result in a gap between the lid front wall and the box front lower section when the lid is closed. This gap may assist a user in opening the lid.

The container may comprise at least one retention tab in the box front upper section, the retention tab protruding from the box front upper section. The retention tab may provide frictional contact to the lid from the inside, when the lid is closed. The retention tab preferably may be located at the upper first longitudinal edge. The container may comprise two retention tabs. In this case one retention tab may be located at the upper first longitudinal edge and the second retention tab may be located in the upper second longitudinal edge. The retention tab further aids in holding lid in the closed position and prevent it from opening inadvertently.

The invention further relates to a blank for forming a container for elongated consumer articles, the blank comprises various panels for forming different parts or walls of the containers. The blank may comprise a box-forming section and a lid-forming section. The lid-forming section may comprise a lid top wall, a lid rear wall, a lid front wall and two lid side walls. The lid rear wall may be connected to the box-forming section of the blank along a lid fold line. The box-forming section of the blank may comprise a box front wall, a box rear wall, a box bottom wall and a first box side wall and second box side wall. The box rear wall may be connected to the lid-forming section along the lid fold line. The box front wall may comprise a box front lower section and a box front upper section. The first box side wall may comprise a first box side lower section and a first box upper section. The second box side wall may comprise a second box side lower section and a second box upper section. The box front lower section may be adjacent to the box bottom wall and the box front upper section may be adjacent to the box front lower section. The blank additionally may comprise a first longitudinal fold line connecting the first box side wall with the box front wall. The upper first longitudinal fold line in the box front upper section of the box front wall may be tilted with respect to a lower first longitudinal fold line in the box front lower section so that the upper first longitudinal fold line may be at an angle to the lower first longitudinal fold line. Furthermore, a height of the box front lower section may be equal to or larger than the total height of the container minus the height of the lid front wall, wherein the total height of the container is the sum of the height of the box rear wall and the height of the lid rear wall. Within this specification, the height of the box front lower section is defined by the distance between the box bottom wall and the vertex point where the tilted upper first longitudinal fold line in the box front upper section diverges from the lower first longitudinal fold line in the box bottom wall.

The invention further relates to a blank for forming a container for elongated articles, the blank comprises various panels for forming different parts or walls of the containers. The blank comprises a box-forming section and a lid-forming section. The lid-forming section comprises a lid top wall, a lid rear wall, a lid front wall and two lid side walls. The lid rear wall is connected to the box-forming section of the blank along a lid fold line. The box-forming section of the blank comprises a box front wall, a box rear wall, a box bottom wall and a first box side wall and second box side wall. The box rear wall is connected to the lid-forming section along the lid fold line. The box front wall comprises a box front lower section and a box front upper section. The first box side wall comprises a first box side lower section and a first box upper section. The second box side wall comprises a second box side lower section and a second box upper section. The box front lower section is adjacent to the box bottom wall and the box front upper section is adjacent to the box front lower section. The blank additionally comprises a first longitudinal fold line connecting the first side wall with the box front wall. The upper first longitudinal fold line in the box front upper section is tilted with respect to a lower first longitudinal fold line in the box front lower section, so that the upper first longitudinal fold line is at an angle to the lower first longitudinal fold line. Furthermore, the height of the box front lower section is equal to or larger than the total height of the container minus the height of the lid front wall, wherein the total height of the container is the sum of the height of the box rear wall and the height of the lid rear wall.

If the height of the box front lower section is equal to or larger than the total height of the container minus the height of the lid front wall, then the box front upper section will be entirely covered by the lid front wall, when the lid is closed. Such a configuration therefore enables one single piece of blank to form an entire container. And such a configuration may also ensure that after the container is manufactured from the blank that the lid closes reliably against the parts of the box front wall, in particular the box front upper section, because the function of an inner frame in existing conventional hinge lid containers is taken over by the upper section of the box front wall and the upper section of the first box side wall and the upper section the second box side wall.

Furthermore, the maximum height of the box front wall may be equal to or smaller than the total height of the container. Furthermore, the maximum height of the box front wall may be larger than the total height of the container minus the height of the lid front wall.

The blank may contain a second longitudinal fold line connecting the second box side wall with the box front wall of the container. An upper second longitudinal fold line in the box front upper section may be tilted with respect to a lower second longitudinal fold line in the box front lower section.

Upon folding the blank, in particular along one or both of the first longitudinal fold line and the second longitudinal fold line, the first and second longitudinal edges of the container may be formed. This container may comprise protruding sections in the box front upper section due to the tilt of the first and second longitudinal fold lines in the front upper section. These protruding sections may enhance the frictional engagement of the upper section of the box with the inner side of the lid and therefore provide safeguard against accidental opening of the lid.

The one or both of the upper first longitudinal fold line and the upper second longitudinal fold line may be tilted by an angle of between 2 degrees to 8 degrees, preferably 4 degrees to 6 degrees, most preferably 5 degrees. Folding the upper first longitudinal fold line and the upper second longitudinal fold line will result in the upper first longitudinal edge and the upper second longitudinal edge of the container. In addition to the advantage on the safeguard against accidental opening, the width of the box front upper section gradually decreasing towards the lid leads to the top end of the box to slightly taper. The tapered top end of the box may also advantageously help the smooth lid closure by reducing the risk that the lid catches the upper edges of the box when the lid rotates to its close position.

A width of the lid top wall may be larger than the width of the box front upper section. Such a configuration of the width of the lid top wall and the box front upper section may ensure that the box front upper section reliably engages with the lid and avoid a collision with the lid by reducing the risk that the lid catches the upper edges of the box when the lid rotates to its close position.

In the blank of the invention, the lid front wall may be formed by one single panel of the blank. Namely one single lid front wall panel on the blank will form the lid front wall. There is no further other panel folding under or being attached to the inner surface of the lid front wall. Such a structure of using one blank panel to form the lid front wall can significantly reduce the above-mentioned gap between the lid front wall and the box front lower section when the lid is closed. Such a configuration enables easy handling of the container in the subsequent packaging process. For example, it can reduce the wrinkles on a wrapper, which surrounds the container when made into the final commercial product.

In the blank of the invention the box rear wall may be connected to the box bottom wall along a rear wall fold line.

In the blank of the invention the box bottom wall, the box rear wall and the lid front wall may be connected to connection taps for assembly of the container. The connection taps may be connected to the box bottom wall, the box rear wall and the lid front wall along fold lines. These fold lines may form edges of the container upon folding. The container may be formed by applying for example an adhesive to the connection taps and gluing the connection taps to the different wall parts of the container, thereby forming the container.

The blank of the invention may be formed as a one-piece of blank. This means that one single blank can be folded, thereby forming the container of the invention. No additional separate structural parts, such as an inner frame need to be connected to the container in order to form the container. Therefore, the blank of the present invention provides a particular easy and reliable way of forming the container by simply folding the blank along the respective folding lines and connecting the different wall parts via the connection taps.

The blank of the present invention may be made of paperboard or plastic or a combination of paperboard and plastic, preferably paperboard.

Subject matter of the present invention is also a method for forming a container for elongated articles. The method may employ a blank as described therein, and may comprise folding the walls of that blank along the fold lines and sealing the walls by applying an adhesive to the connection taps and connecting the connection taps with wall parts of the container. Due to the tilt of one or both of the upper first longitudinal fold line and the upper second longitudinal fold line, one or both of the upper first longitudinal edge and the second longitudinal edge with tilt angles in the box front upper section may be formed. These tilt angles may lead parts of the box front upper section, the first box side upper section and the second box side upper section to protrude outwards when the blank is folded.

Subject matter of the present invention is also a method for forming a container for elongated consumer articles. The method employs a blank as described therein, comprising folding the walls of that blank along the fold lines and sealing the walls by applying an adhesive to the connection taps and connecting the connection taps with wall parts of the container. Due to the tilt angle of one or both of the upper first longitudinal fold line and the upper second longitudinal fold line, one or both of the upper first longitudinal edge and the upper second longitudinal edge with tilt angles in the front upper section of the box are formed. These tilt angles lead to parts of the box front upper section, the first box side upper section and the second box side upper section to protrude outwards when the blank is folded.

Features described in relation to one embodiment may equally be applied to other embodiments of the invention. The same reference numerals denote the same elements throughout the drawings.

The invention will be further described, by way of example only, with reference to the accompanying drawings in which.

Figure 1:
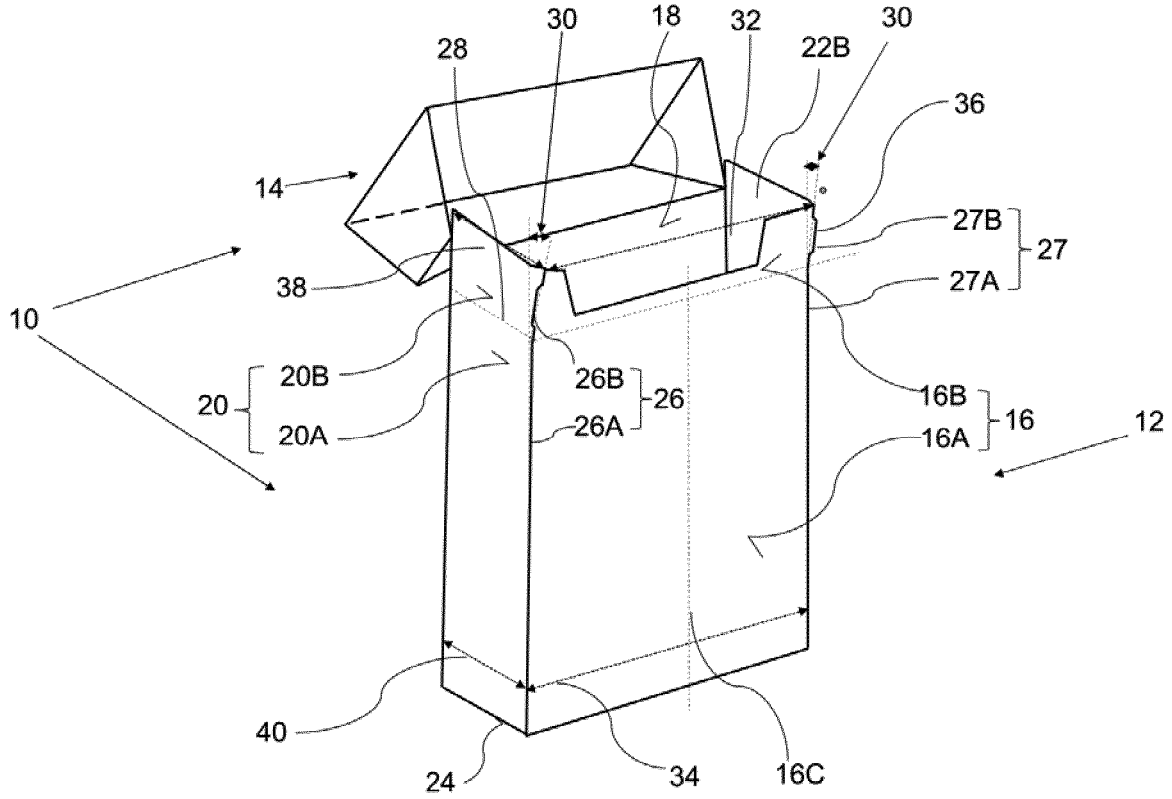
FIG. 1 shows a perspective view of a container according to one embodiment of the present invention.

Referring to FIG. 1, a schematic perspective view of an embodiment of a container 10 for housing elongated articles is depicted. The container comprises a lid 14 and a box 12. The box 12 comprises a box front wall 16 comprising a box front lower section 16A and a box front upper section 16B. Furthermore, a first box side wall 20 is present, including a first box side wall lower section 20A and a first box side wall upper section 20B. The box further comprises a second box sidewall 22, of which only the second box side wall upper section 22B is shown in FIG. 1. The box also comprises a box bottom wall 24 and a box rear wall 18. The upper sections of the box front wall and the box side walls are separated from the respective lower sections of the box front wall and the box side walls by an imaginary separation line 28. This separation line 28 is entirely covered by the lower edge of the lid, when the lid 14 is in its closed position. The lid 14 therefore covers the first box side upper section 20B, the box front upper section 16B, and the box second side upper section 22B when the lid is closed.

A first longitudinal edge 26 connects the box front wall 16 to the first box side wall 20. A lower first longitudinal edge 26A in the box front lower section 16A is present. In the box front upper section 16B a upper first longitudinal edge 26B is present, which is tilted by an angle 30 with respect to the lower first longitudinal edge 26A in the front lower section. This results in the width 32 of the box front upper section being smaller than the width 34 of the box front lower section. Additionally, the width 38 of the first side upper section is larger than the width 40 of the first side lower section. Similarly, a second longitudinal edge 27 connects box front wall 16 to the second box side wall 22. The upper second longitudinal edge 27B in the box front upper section is tilted by the inclination angle 30 with respect to the lower second longitudinal edge 27A in the box front lower section. Both of the upper first longitudinal edge 26B and the upper second longitudinal edge 27B are tilted towards a central longitudinal axis 16C of the box front wall. The box further comprises retention tabs 36 in the box front upper section. These retention tabs can frictionally engage with the lid, when the lid is in its closed position. The inclination angles 30 of the upper first longitudinal edge 26B and the upper second longitudinal edge 27B in the front upper section result in the box front upper section protruding outwards. The protruding box front upper section can advantageously engage with the lid from the inside of the lid when it gets closed. The tapered top end of the box, particularly on the box front upper section, may also ensure a smooth closing of the lid when the lid rotates to its close position by preventing the upper edges of the box front wall and the box side walls from catching with the lower edges of lid front wall and the lid side walls.

Figure 2:
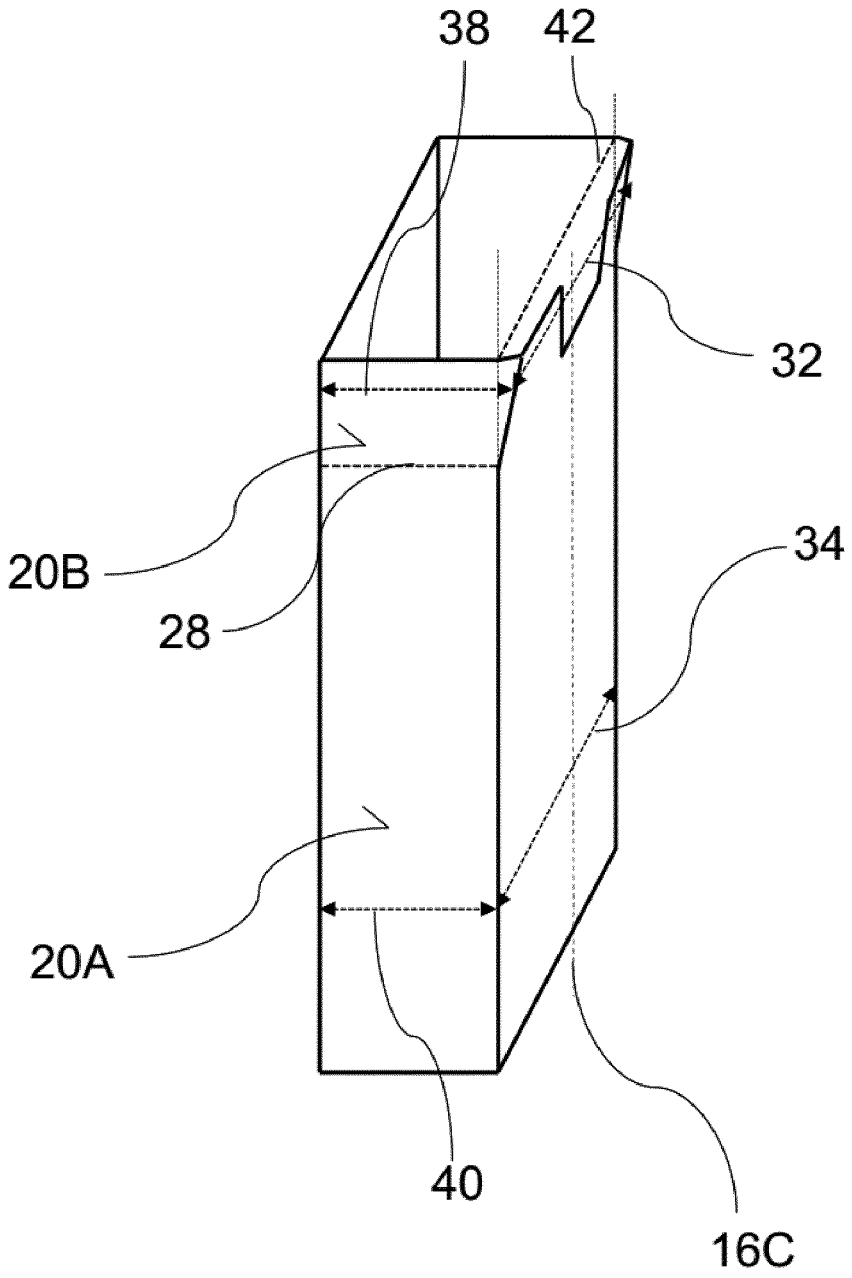
FIG. 2 shows a perspective view from the side of a box portion of the container.

FIG. 2 shows a perspective side view of the box portion 12 of the container 10 shown in FIG. 1. The dashed line 42 shows the position of the box front upper section which would be present if the upper first longitudinal edge and the upper second longitudinal edge in the front upper section are not tilted. It can clearly be seen that the box front upper section is slightly protruding outwards, which enables an enhanced frictional interaction with the lid when it's closed.

Figure 3:
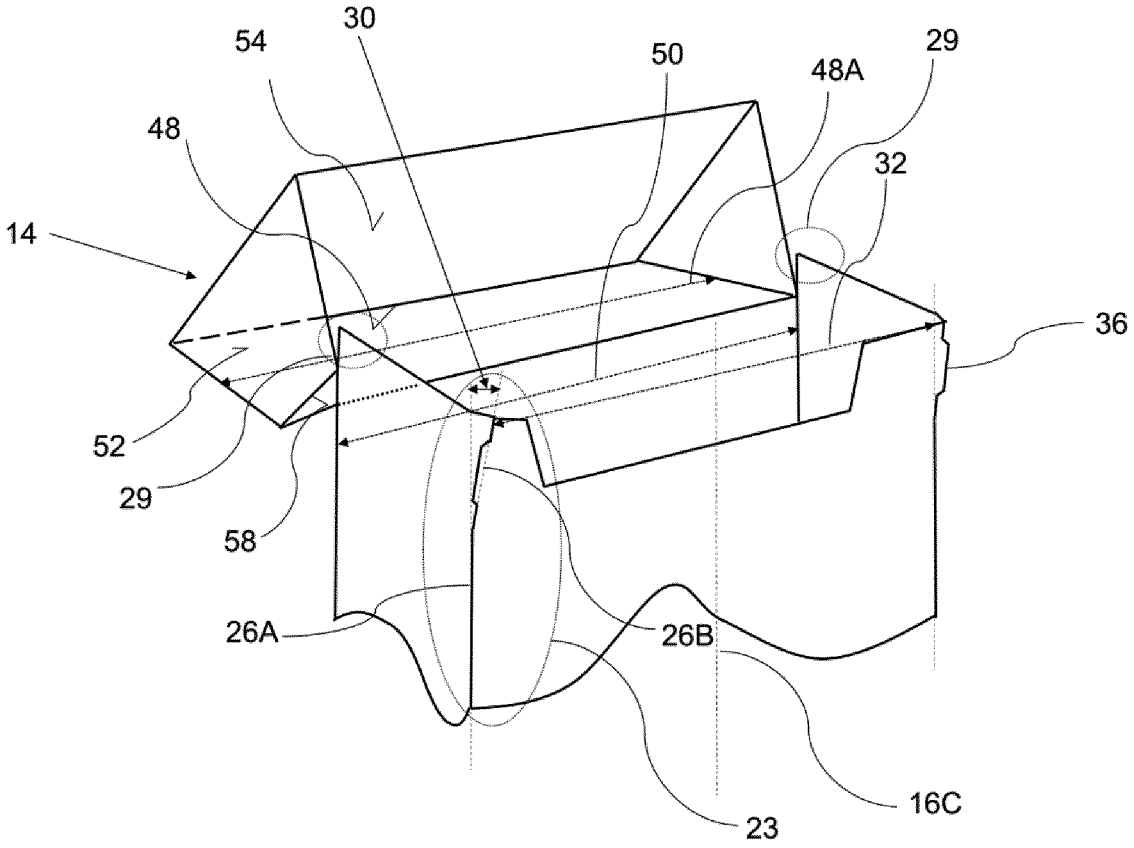
FIG. 3 shows a perspective view of the front upper section and the first side upper section of a container together with the lid.

FIG. 3 shows an enlarged perspective view of the top portion of the container with the lid 14. Lid 14 comprises the lid rear wall 58, the lid side walls 52, the lid front wall 54 and the lid top wall 48. The width 48A of the lid top wall 48 is shown as a dashed line. This width 48A of the lid top wall is larger than the with 50 of the rear upper section of the box. Due to the dimensional configuration of the width of the lid top wall and the rear upper section of the box, the larger width of the lid top wall 48 may lead at least parts of the lid side walls 52 to protrude slightly outwards in comparison with the first box side upper section 20B and the second box side upper section 22B so that the lid side walls 52 can be prevented from colliding with the box side walls when pivoting the lid from the open position to the close position. Therefore, the lid 14, particularly the bulging lid side walls 52 can ensure an easy and smooth closure to cover the box without any major interference from the edges of the box side walls, which are shown in the dashed circles denoted with the reference sign 29.

Figure 4:
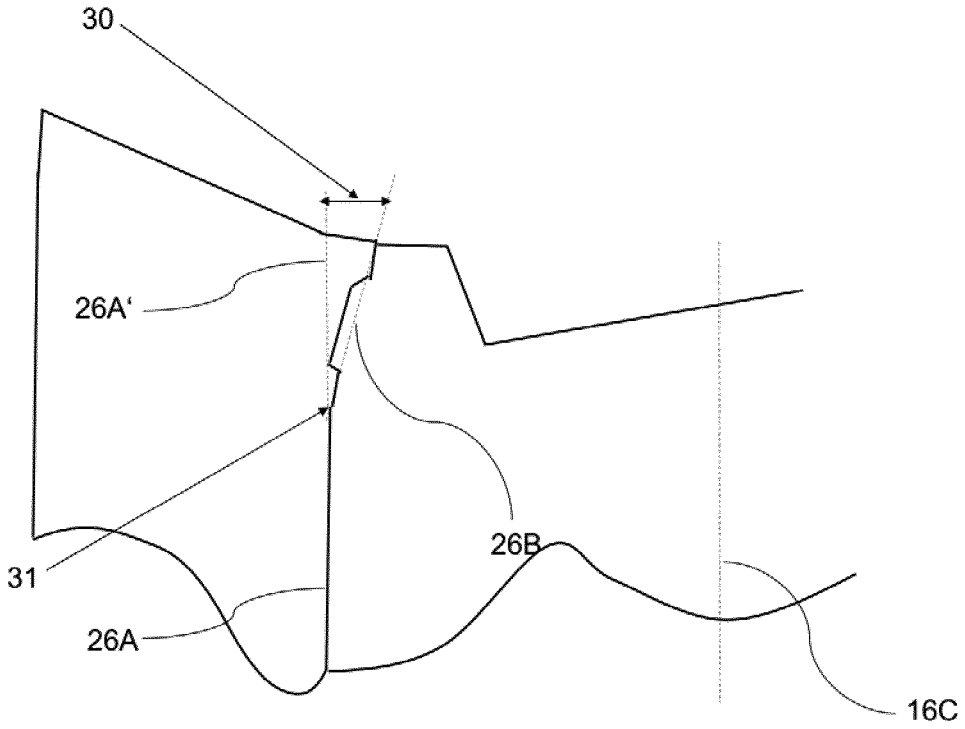
FIG. 4 depicts a closeup of the first longitudinal edge portion of FIG. 3 showing in detail the determination of the tilt angle.

FIG. 4 shows a perspective closeup view of the region marked by the dashed circle 23 in FIG. 3. The FIG. 4 shows one way of determining the tilt angle 30. The lower first longitudinal edge 26A in the box front lower section is shown. At the vertex point 31, the upper first longitudinal edge 26B in the box front upper section diverges from the lower first longitudinal edge 26A in the box front lower section. The tilt angle 30 can be measured as the angle between the tilted upper first longitudinal edge 26B and an imaginary line 26A' of the lower first longitudinal edge 26A, which is a straight extension from the box front lower section into the box front upper section. In this case the first longitudinal edge 26B in the box front upper section is tilted towards the central longitudinal axis of the box front wall 16C.

Figure 5:
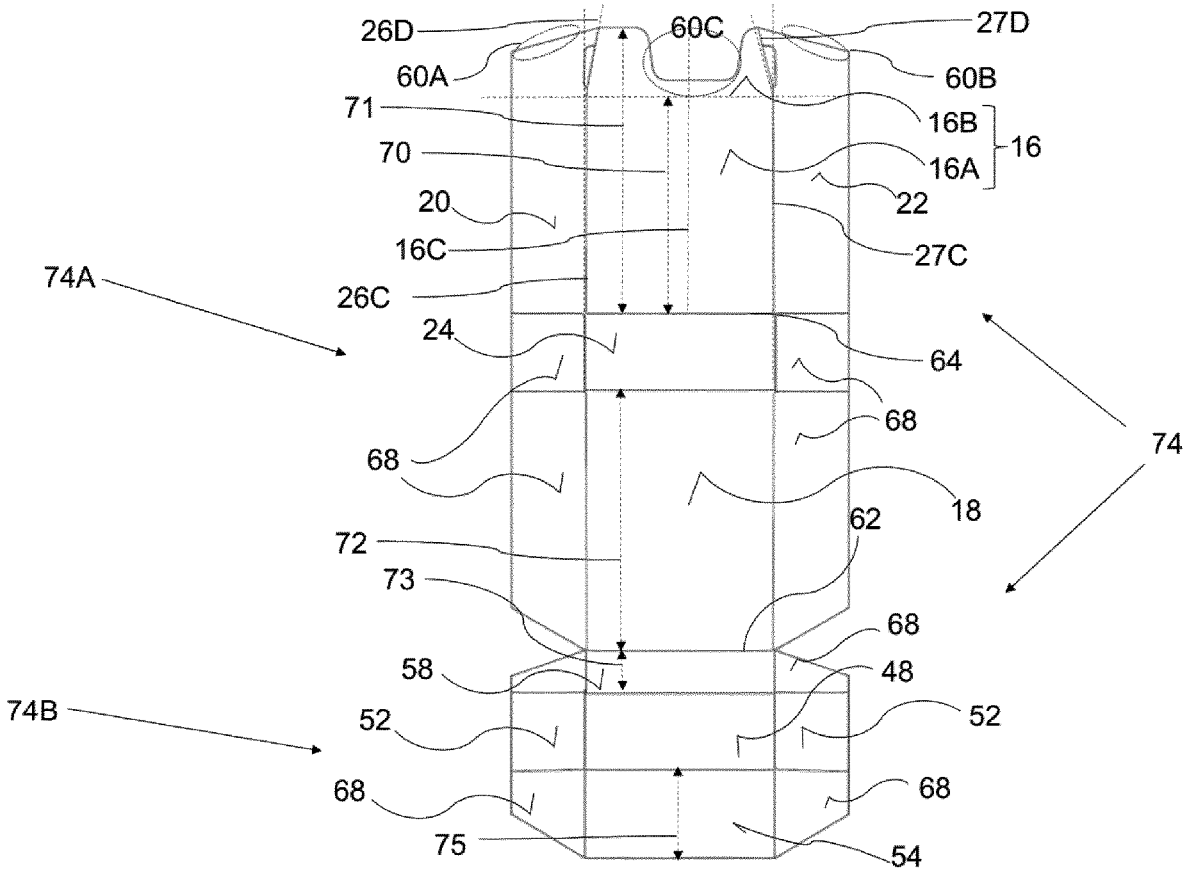
FIGS. 5-7 show different embodiments of blanks for forming containers of the invention.

FIG. 5 shows one example of a blank 74 for forming a container of the present invention. The blank 74 comprises a box forming section 74A and a lid forming section 74B. The box forming section 74A comprises a box front wall 16 which is connected to a first box side wall 20 by a lower first longitudinal fold line 26C in the box front lower section and an upper first longitudinal fold line 26D in the box front upper section. Additionally, the box front wall 16 is connected to a second box side wall 22 by a lower second longitudinal fold line 27C in the box front lower section and a upper second longitudinal fold line 27D in the box front upper section. The first and second longitudinal fold lines 26D and 27D are tilted towards the central longitudinal axis 16C of the box front box wall 16. Both the first box side wall 20 and the second box side wall 22 comprise upper edges 60A and 60B sloping downwardly from the box front wall to the box rear wall. These sloped upper edges of the box side walls 20, 22 serve to minimize the interference of the box side walls with the lid side wall at the initial move of the lid upon pivoting from the open position to the close position and therefore help the smooth closing of the lid by avoiding any collision between the lid and the box.

A bottom fold line 64 connects the box front wall 16 to the box bottom wall 24. This box bottom wall 24 is also separated by a fold line from the adjacent rear wall 18. The box rear wall 18 is connected by the lid fold line 62 to the lid-forming section 74B of the blank. In particular, the box rear wall 18 is connected to the lid rear wall 58, which is directly connected to the lid top wall 48 through another fold line. The lid top wall 48 is connected to the lid sidewalls 52 and the lid front wall 54 through further fold lines. Connection taps 68 are present which are connected to the respective walls of the blank through further fold lines.

A U-shaped cut-out region indicated by the dashed circle 60C is present in the box front upper section of the box front wall 16, which serves to ease the withdrawal of elongated articles from the container. The height 70 of the box front lower section is shown. This height is equal to or larger than the total height of the container minus the height 75 of the lid front wall. The total height of the container is the sum of the height 72 of the box rear wall and the height 73 of the lid rear wall. These height proportions can ensure that the lid front wall can reliably cover, particularly entirely cover the box front upper section after the container has been folded from the blank. The maximum height 71 of the complete box front wall is also depicted.

Figure 6:
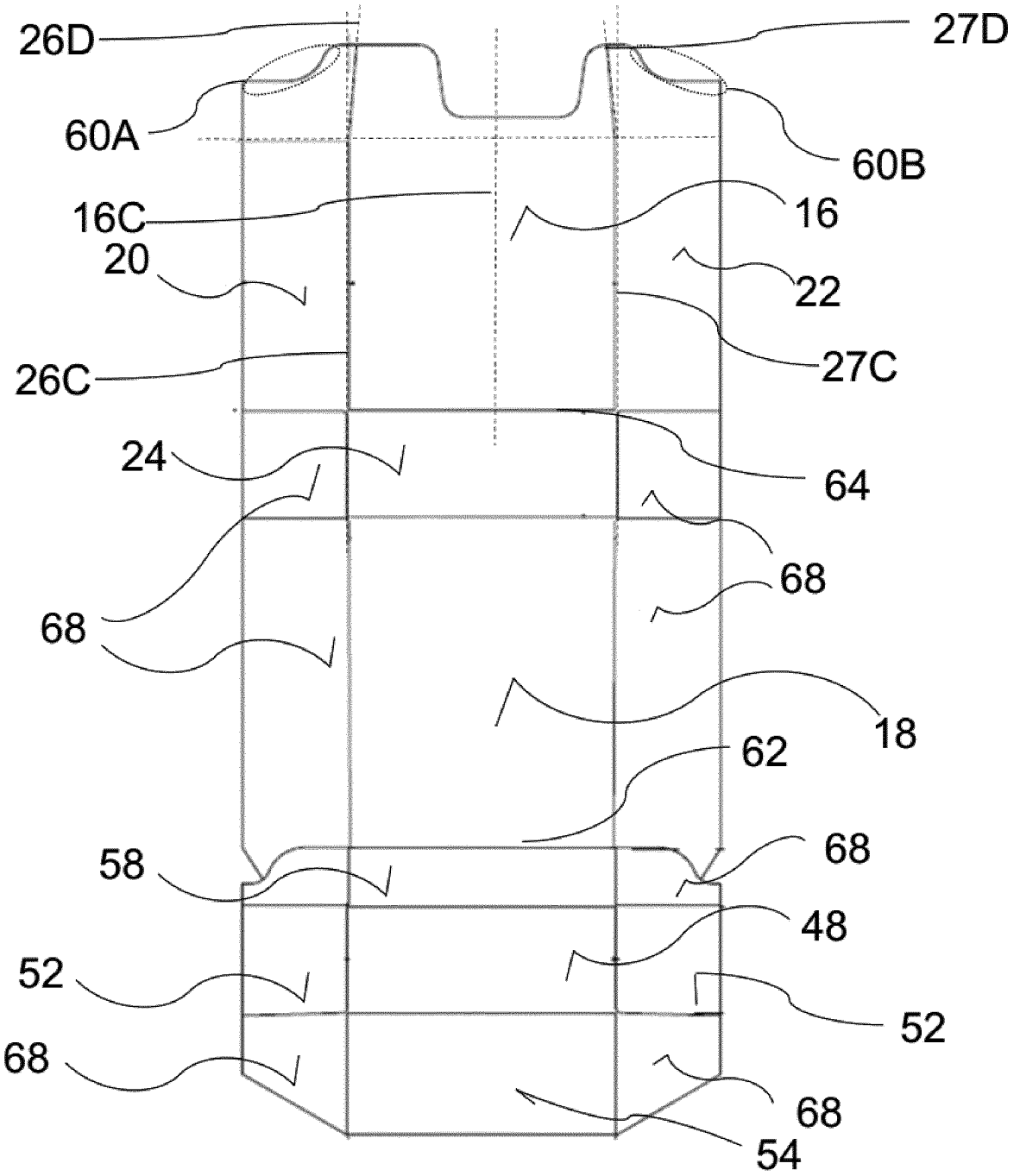

FIG. 6 shows a blank for forming another container according to the invention. In comparison to the blank shown in FIG. 5 different shaped edges 60A and 60B are present in the upper sections of the first and second box side walls. These edges 60A and 60B in FIG. 6 comprise a recess formed by a cut-out portion, which differ from the sloped straight edges 60A and 60B shown in the blank of FIG. 5. This is another design of the edges of the first and second box side walls in order to avoid any interference of the box side walls during closing of the lid.

Figure 7:
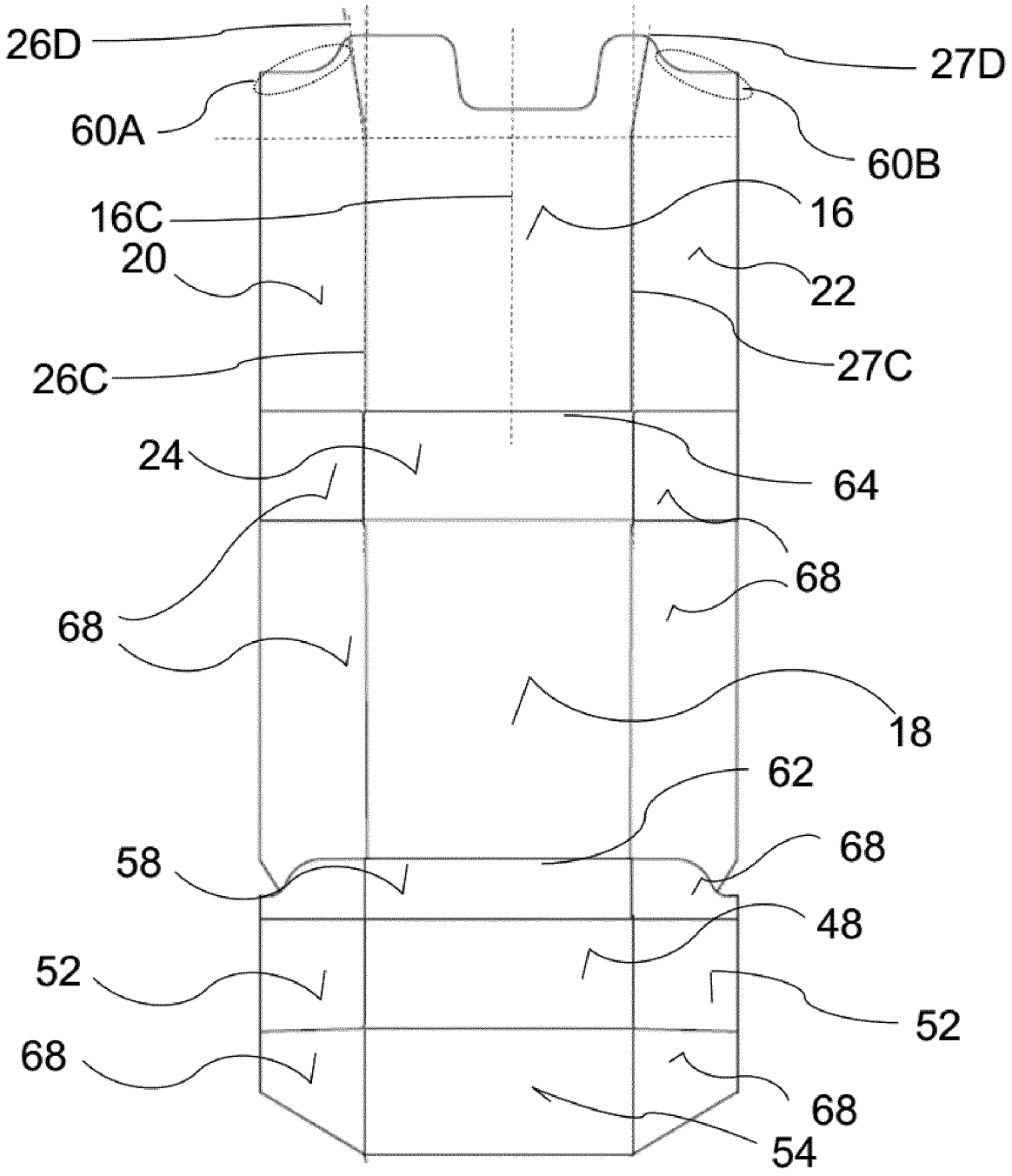

FIG. 7 shows a blank for yet another container according to the invention. In comparison to the blank shown in FIG. 6 the upper first longitudinal fold line 26D and the upper second longitudinal fold line 27D in the front upper section are tilted away from the central longitudinal axis 16C of the box front wall 16 and are tilted toward the box side walls.

Figure 8:
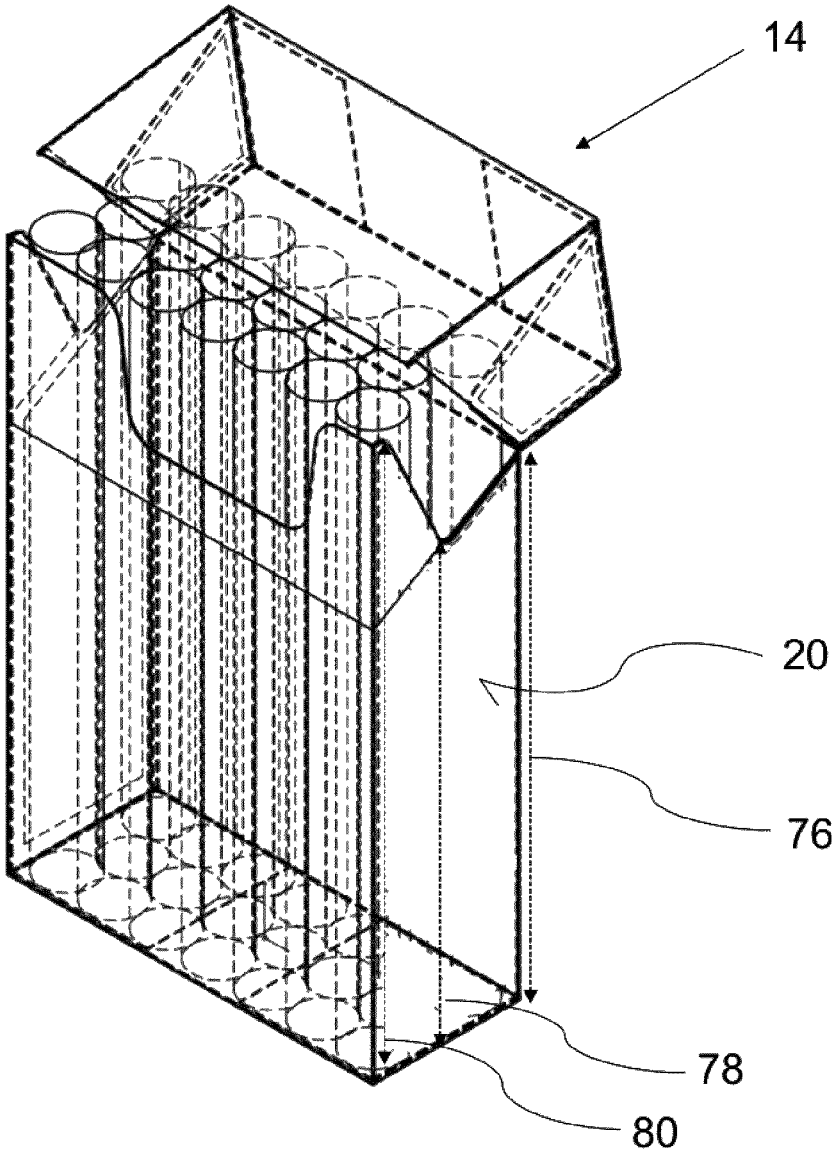
FIGS. 8 and 9 show a different embodiment of a container of the invention in a perspective view and in a side view.

FIG. 8 shows a perspective view of another embodiment of the container of the present invention. For the sake of clarity, the tilted upper first longitudinal edge in the box front upper section is not shown. This container comprises a first box side wall 20 with a height 76 of the first box side wall adjacent to the box rear wall, a minimum height 78 of the first box side wall and a height 80 of the first box side wall adjacent to the box front wall are indicated. It can clearly be seen that the first box side wall 20 comprises a recessed upper edge formed by a cut-out portion, wherein a minimum height 78 of the first box side wall is smaller than the height 76 of the first box side wall adjacent to the rear wall. This container comprises a second box side wall, where symmetrically the second box side wall may comprise the same structural configuration as the first box side wall 20. In comparison with the container embodiment of the invention formed by the blank shown in FIG. 5, such a configuration of the recessed upper edges of the box side walls may further minimize the interference of the box side walls with the lid side wall, particularly at the initial move of the lid upon pivoting from the open position to the close position. Therefore, the cut-out portions on the recessed upper edges of the box side walls advantageously ensure a smooth closing of the lid by avoiding any collision between the lid and the box.

Figure 9:
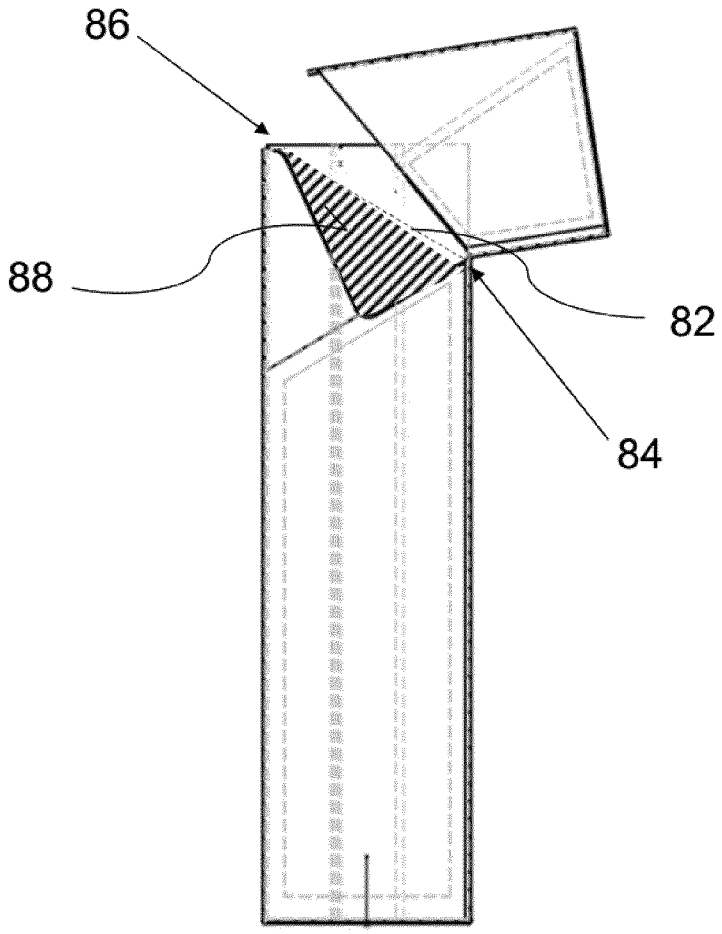

FIG. 9 shows a side view of the container of FIG. 8. The cut-out portion as indicated by the hatched area 88 is the part of the container blank which is removed for forming the recessed upper edge of one box side wall. This hatched area 88 is located below an imaginary connecting line 82 drawn between the upper edge 86 of the first box side wall which is adjacent to the box front wall and the upper edge 84 of the first box side wall which is adjacent to the box rear wall.

The invention claimed is:

1. A container for consumer goods including elongated articles, the container comprising:

from a one-piece blank, a box configured to house the consumer goods, the box comprising a box front wall, a box rear wall, a first box side wall, a second box side wall, and a box bottom wall, wherein a top end of the box is at least partially open and configured to provide an access opening to access the consumer goods;

a lid pivotably connected to the box rear wall along a hinge, wherein the lid is pivotable about the hinge between a closed position, in which the lid covers the access opening, and an open position, in which the access opening is exposed; and a first longitudinal edge connecting the first box side wall with the box front wall, the box front wall comprising a box front lower section and a box front upper section, the first box side wall comprising a first box side lower section and a first box side upper section, the second box side wall comprising a second box side lower section and a second box side upper section, wherein the box front lower section, the first box side lower section, and the second box side lower section are adjacent to the box bottom wall, wherein the box front upper section, the first box side upper section, and the second box side upper section are configured to be covered by the lid when the lid is in the closed position, and wherein an upper first longitudinal edge in the box front upper section is tilted with respect to a lower first longitudinal edge in the box front lower section so that the upper first longitudinal edge is at an angle to the lower first longitudinal edge.

2. The container according to claim 1, further comprising a second longitudinal edge connecting the second box side wall with the box front wall, wherein an upper second longitudinal edge in the box front upper section is tilted with respect to a lower second longitudinal edge in the box front lower section so that the upper second longitudinal edge is at an angle to the lower second longitudinal edge.

3. The container according to claim 2, wherein one or both of the upper first longitudinal edge and the upper second longitudinal edge are tilted towards a central longitudinal axis of the box front wall.

4. The container according to claim 2, wherein one or both of the upper first longitudinal edge and the upper second longitudinal edge are tilted by an angle of between 2 degrees to 8 degrees.

5. The container according to claim 1, wherein a minimum height of the first box side wall adjacent to the box rear wall, a minimum height of the second box side wall adjacent to the box rear wall, or both a minimum height of the first box side wall and the second box side wall adjacent to the box rear wall is at a same height or lower than a height of the box rear wall.

6. The container according to claim 1, wherein an upper edge of the first box side upper section, an upper edge of the second box side upper section, or both the upper edges of the first box side upper section and the second box side upper section comprises a recess formed by a cut-out portion.

7. The container according to claim 1, wherein a narrowest width of the box front upper section is between 0.1 percent to 5 percent smaller than a width of the box front lower section.

8. The container according to claim 1, wherein the box front lower section is in a same plane with the box front upper section.

9. The container according to claim 1, further comprising at least one retaining tab in the box front upper section, the retaining tab protruding from the box front upper section.

10. The container according to claim 1, wherein the lid comprises a lid top wall, and wherein a width of the lid top wall is larger than a width of the box rear wall.

11. The container according to claim 10, wherein the width of the lid top wall is up to 2 mm larger than the width of the box rear wall.

12. A blank for forming a container for elongated articles according to claim 1, the blank comprising:

a box-forming section and a lid-forming section; and a first longitudinal fold line connecting the first box side wall with the box front wall, wherein the lid-forming section comprises a lid top wall, a lid rear wall, a lid front wall, and two lid side walls, wherein the lid rear wall is connected to the box-forming section along a lid fold line, wherein the box-forming section comprises a box front wall, a box rear wall, a box bottom wall, a first box side wall, and second box side wall, wherein the box rear wall is connected to the lid-forming section along the lid fold line, wherein the box front wall comprises a box front lower section and a box front upper section, wherein the first box side wall comprises a first box side lower section and a first box upper section, wherein the second box side wall comprises a second box side lower section and a second box upper section, wherein the box front lower section is adjacent to the box bottom wall, wherein an upper first longitudinal fold line in the box front upper section is tilted with respect to a lower first longitudinal fold line in the box front lower section so that the upper first longitudinal fold line is at an angle to the lower first longitudinal folding line, wherein a height of the box front lower section is equal to or larger than a total height of the container minus a height of the lid front wall, and wherein the total height of the container is the sum of a height of the box rear wall and a height of the lid rear wall.

13. The blank according to claim 12, further comprising a second longitudinal fold line connecting the second box side wall with the box front wall, wherein an upper second longitudinal fold line in the box front upper section is tilted with respect to a lower second longitudinal fold line in the box front lower section so that the upper second longitudinal fold line is at an angle to the lower second longitudinal fold line.

14. The blank according to claim 13, wherein the upper first longitudinal fold line, the upper second longitudinal fold line, or both the upper first longitudinal fold line and the upper second longitudinal fold lines are tilted by an angle of between 2 degrees to 8 degrees.

15. The blank according to claim 13, wherein a minimum height of the first box side wall adjacent to the box rear wall, a minimum height of the second box side wall adjacent to the box rear wall, or both a minimum height of the first box side wall and the second box side wall adjacent to the box rear wall is at a same height or lower than a height of the box rear wall.

16. The blank according to claim 15, wherein an upper edge of the first box side wall, an upper edge of the second box side wall, or both the upper edges of the first box side wall and the second box side wall comprises a recess formed by a cut-out portion.

* * * * *